US011069456B2

(12) United States Patent
Hermans

(10) Patent No.: US 11,069,456 B2
(45) Date of Patent: Jul. 20, 2021

(54) SILENT CONDUCTOR

(71) Applicant: LAMIFIL, Hemiksem (BE)

(72) Inventor: Peter Hermans, Ostend (BE)

(73) Assignee: LAMIFIL, Hemiksem (BE)

( * ) Notice: Subject to any disclaimer, the term of this patent is extended or adjusted under 35 U.S.C. 154(b) by 0 days.

(21) Appl. No.: 16/765,897

(22) PCT Filed: Nov. 21, 2018

(86) PCT No.: PCT/IB2018/059179
§ 371 (c)(1),
(2) Date: May 21, 2020

(87) PCT Pub. No.: WO2019/102372
PCT Pub. Date: May 31, 2019

(65) Prior Publication Data

US 2020/0357536 A1 Nov. 12, 2020

(30) Foreign Application Priority Data

Nov. 21, 2017 (BE) ..... 2017/5851

(51) Int. Cl.
*H01B 5/10* (2006.01)
*H01B 1/02* (2006.01)

(52) U.S. Cl.
CPC ..... *H01B 5/10* (2013.01); *H01B 1/023* (2013.01); *H01B 1/026* (2013.01)

(58) Field of Classification Search
CPC ..... H01B 1/02; H01B 1/023; H01B 1/026; H01B 5/004; H01B 5/006; H01B 5/08;
(Continued)

(56) References Cited

U.S. PATENT DOCUMENTS 3,445,586 A 5/1969 Edwards et al.
5,711,143 A * 1/1998 Munakata ..... H01B 5/104 57/215

(Continued)

FOREIGN PATENT DOCUMENTS

CN 203192526 U * 9/2013 ..... H01B 9/02
DE 275218 C 5/1913
FR 787394 A 9/1935

OTHER PUBLICATIONS

Ash et al., "Conductor Systems for Overhead Lines: Some Considerations in their Selection," Proceedings of the Institution of Electrical Engineers, IEEE, vol. 126, No. 4, Apr. 1, 1979, pp. 333-341.

(Continued)

*Primary Examiner* — William H. Mayo, III
(74) *Attorney, Agent, or Firm* — Workman Nydegger

(57) ABSTRACT

A conductor for power transportation includes an elongated core constructed from a core material and an elongated conductive casing constructed from a conductive material. The elongated conductive casing is positioned around the elongated core and constructed from various layers of wires. Each layer of wires consists of a set of wires which are positioned next to each other, and at least a fraction of these wires being shaped in such a way that for the cross section of the wire, a circumscribed circle is filled only with between 50% and 90% of wire material. The cross section of the wire has a central portion filled with wire and a plurality of protrusions. The shape of these wires is such that the space taken up by these wires in the stack of wires in the layers is substantially cylindrical.

20 Claims, 3 Drawing Sheets

(58) Field of Classification Search
CPC ..... H01B 5/10; H01B 5/101; H01B 5/102; H01B 5/104; H01B 5/105
USPC .... 174/102 R, 103, 106 R, 108, 109, 102 A, 174/115, 116, 40 R, 42
See application file for complete search history.

(56) References Cited

U.S. PATENT DOCUMENTS

| | | | | |
|---|---|---|---|---|
| 6,331,677 | B1 * | 12/2001 | Munakata | H01B 5/104 174/128.1 |
| 7,622,681 | B2 * | 11/2009 | Kikuchi | H01B 5/006 174/128.2 |
| 8,969,728 | B2 * | 3/2015 | Dorffer | D07B 1/08 174/129 R |
| 2007/0193767 | A1 * | 8/2007 | Guery | H01B 5/105 174/106 R |
| 2015/0027773 | A1 * | 1/2015 | Guery | H01B 7/0009 174/40 R |
| 2015/0279518 | A1 * | 10/2015 | Comoret | C25D 11/04 174/70 A |

OTHER PUBLICATIONS

Search Report and Written Opinion from corresponding BE Application No. BE201705851, dated Jul. 9, 2018.
International Search Report and Written Opinion from PCT Application No. PCT/IB2018/059179, dated Feb. 22, 2019.

* cited by examiner

FIG. 2(a)
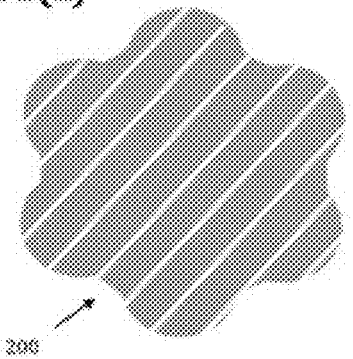
FIG. 2(b)
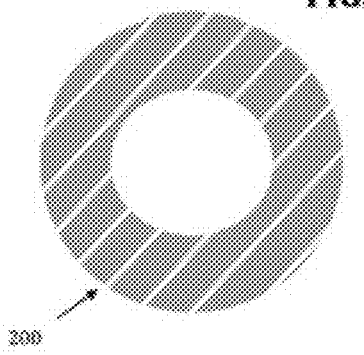
FIG. 2(c)
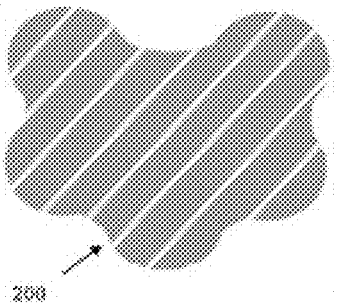
FIG. 2(d)
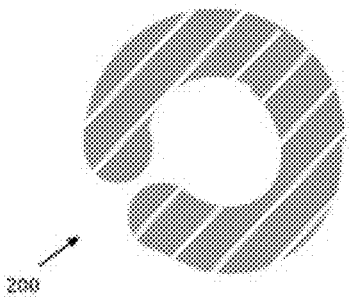
FIG. 2(e)
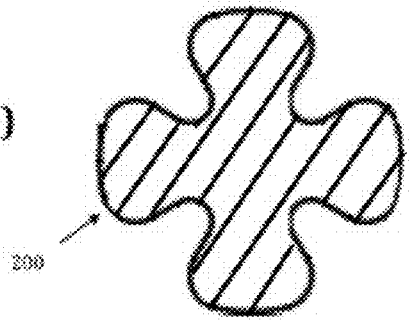
FIG. 2

SILENT CONDUCTOR

AREA OF APPLICATION OF THE INVENTION

This invention relates generally to power transportation. More specifically, the present invention relates to conductors such as cables for power transportation and power distribution, as well as methods for producing conductors of this type, in which the cables generate as little noise as possible that can be attributed to the voltage (Corona) or current (Lorenz forces).

BACKGROUND OF THE INVENTION

There is an electric field around conductors. This field is strongest at the conductor surface. The smaller the local radius, the stronger the electric field will be locally. Occasionally, the electric field is so strong that the air can be caused to ionise locally (Corona). The behaviour of water droplets and impurities in this alternating field leads to potentially disruptive noise, more specifically if a predominant low tone in the spectrum occurs, in this case 100 Hz and harmonics thereof. Various analyses attribute the noise specifically to the behaviour of water droplets in this zone, the explanation for the 100 Hz being that the field passes through an amplitude extremum twice per cycle. It is known that this phenomenon is dependent on the diameter of the conductor; specifically, the greater the diameter, the less this effect occurs, and this is in accordance with considerations relating to the dependency between the size of the electrical field and the diameter of the conductor.

In the past, a number of proposals have already been made for manufacturing a conductor with a large diameter. A first example is a conductor in which some of the wires forming the casing are made of a polymer so as to reduce the total mass of the conductor and thus to make a conductor having a larger diameter with the same mass.

A second example is a GAP conductor, in which a split is introduced between the core and the casing.

A third example is an expanded hollow tube having a ribbed core conductor.

However, there is still room for improvement.

SUMMARY OF THE INVENTION

An objective of embodiments of the present invention is to provide good conductors for power transportation.

An advantage of embodiments of the present invention is that good conductors can be provided, for example overhead lines of trains, overground high-voltage cables for power transportation or power distribution, and all other applications where conductors are used, the conductors causing little or no disruption for example being less susceptible to disruptive noise production (monotone or otherwise) which directly or indirectly accompanies the occurring alternating electromagnetic fields.

This object is achieved by a product or a use in accordance with embodiments of the present invention.

The present invention relates to a conductor for power transportation, the conductor comprising an elongated core constructed from a core material and an elongated conductive casing constructed from a conductive material, the elongated conductive casing being positioned around the elongated core and being constructed from various layers of wires, each layer of wires consisting of a set of wires which are positioned next to each other, and at least a fraction of these wires being shaped in such a way that for the cross section of the wire there is a circumscribed circle only filled between 50% and 90% with wire material. The cross section of the wire has a central portion filled with wire material (in other words the wire is not hollow) and there is a plurality of protrusions (i.e. parts which project out from the central portion). The shape of these wires is further such that the space (room) taken up by these wires in the stack of wires in the layers is substantially cylindrical.

The above condition may also be worded differently to the effect that the wires provide a casing in which the layers of the casing have a lower degree of filling than if the layers were constructed by wires having a disc as a cross section.

An advantage of the embodiments of the present invention is that, at the same mass of the conductor as in conventional conductors, a conductor having a larger diameter is obtained. This results in a reduction in the local electromagnetic field, and thus a reduction in the hum of the conductor.

The majority of the wires in the layers, for example all of the wires in the layers, can be shaped in such a way that for the cross section of the wire a circumscribed circle is only between 50% and 90% filled with wire material.

An advantage of the embodiments of the present invention is that conductors having a different diameter can be made in a simple manner. This makes it possible to adapt the diameter of the conductor in such a way that a diameter can be selected at which no corona effects occur. This diameter may be dependent on local parameters and on the typically occurring voltages.

An advantage of embodiments of the present invention is that the conductors are high-temperature conductors, this not being the case for example if a number of the wires are replaced with polymer wires so as to obtain a lower mass at the same diameter.

At least one of the wires may have a cross section having a central portion filled with wire material and having a plurality of protrusions made of wire material.

The plurality of protrusions may touch the circumscribed circle.

The plurality of protrusions may be of a similar shape, for example the same shape.

The plurality of protrusions may be of a lobe shape.

The plurality of protrusions may be evenly distributed over the periphery of the cross section.

The plurality of protrusions may be configured in such a way that they exhibit a widening close to the circumscribed circle.

An advantage of the embodiments of the present invention is that because of the widening of the outer ends of the protrusions the tops are wider than the intermediate, deeper portions, in such a way that the wires cannot slide into one another.

At least one of the wires may have a cross section having a hollow central portion.

The cross section may be point-symmetrical.

The cross section may be asymmetrical.

The cross section may, at least in every quadrant of the circumscribed circle, have wire material which touches the circumscribed circle.

In the cross section of the wire, the circumscribed circle may only be between 50% and 80% full of wire material, i.e. the circumscribed circle is only filled with wire material between 50% and 80%.

The wire may be a cylindrical wire provided with a plurality of grooves in the outer edge of the cylindrical wire.

One or more of the wires may be twisted. An advantage of the embodiments of the present invention is that, as a result of the twisting of the wires along the longitudinal direction thereof, the points of the cross section of the wire which touch the circumscribed circle are not located in fixed positions along the length of the casing, and so these points can form support points for adjacent wires, in such a way that the wires cannot slide into one another.

At least one of the wires may be wound around the central core. Preferably, wires within the same layer follow the same winding, in such a way that they can subsequently be positioned within the layer.

Different wires in the same or different layers may have a different cross section.

The wires of the conductive casing may consist of a material selected from one of copper, copper alloy, aluminium or aluminium alloy.

The core may be made from a core material selected from one or more of invar, metal matrix composite, polymer matrix composite, steel, aluminium-coated steel, copper-coated steel or stainless steel.

In another aspect, the present invention also relates to a conductive wire, the wire being shaped in such a way that for the cross section of the wire there is a circumscribed circle filled only with between 50% and 90% of wire material, for example only between 50% and 80%. The cross section of the wire has a central portion filled with wire material (in other words the wire is not hollow) and there is a plurality of protrusions (i.e. parts which project out from the central portion). The shape of the wire is such that when these wires are stacked the space (room) taken up is substantially cylindrical.

The cross section may have a central portion, filled with wire material, and a plurality of protrusions.

The plurality of protrusions may touch the circumscribed circle.

The plurality of protrusions may be of a similar shape.

The plurality of protrusions may be of a lobe shape.

The plurality of protrusions may be evenly distributed over the periphery of the cross section.

The plurality of protrusions may be configured in such a way that they exhibit a widening close to the circumscribed circle.

The cross section may have a hollow central portion.

The cross section may be point-symmetrical.

The cross section may be asymmetrical.

In the cross section, wire material may touch the circumscribed circle at least in every quadrant.

The wire may be twisted.

In another aspect, the present invention relates to the use of a conductive wire as described above for manufacturing a conductor for power transportation, for example for manufacturing a conductor as described above.

The present invention also relates to a cable comprising a conductor in accordance with any of the preceding claims Specific, advantageous aspects of the invention are taken up in the accompanying independent and dependent claims. Features of the dependent claims may be combined with features of the independent claims and with features of other dependent claims as indicated and not only as expressly set out in the claims.

These and other aspects of the invention will be apparent from and are clarified with reference to the embodiments described hereinafter.

BRIEF DESCRIPTION OF THE DRAWINGS

FIGS. 2(*a*) to 2(*e*) show possible cross sections of wires which may be used in a conductor in accordance with embodiments of the present invention.

Figure 1:
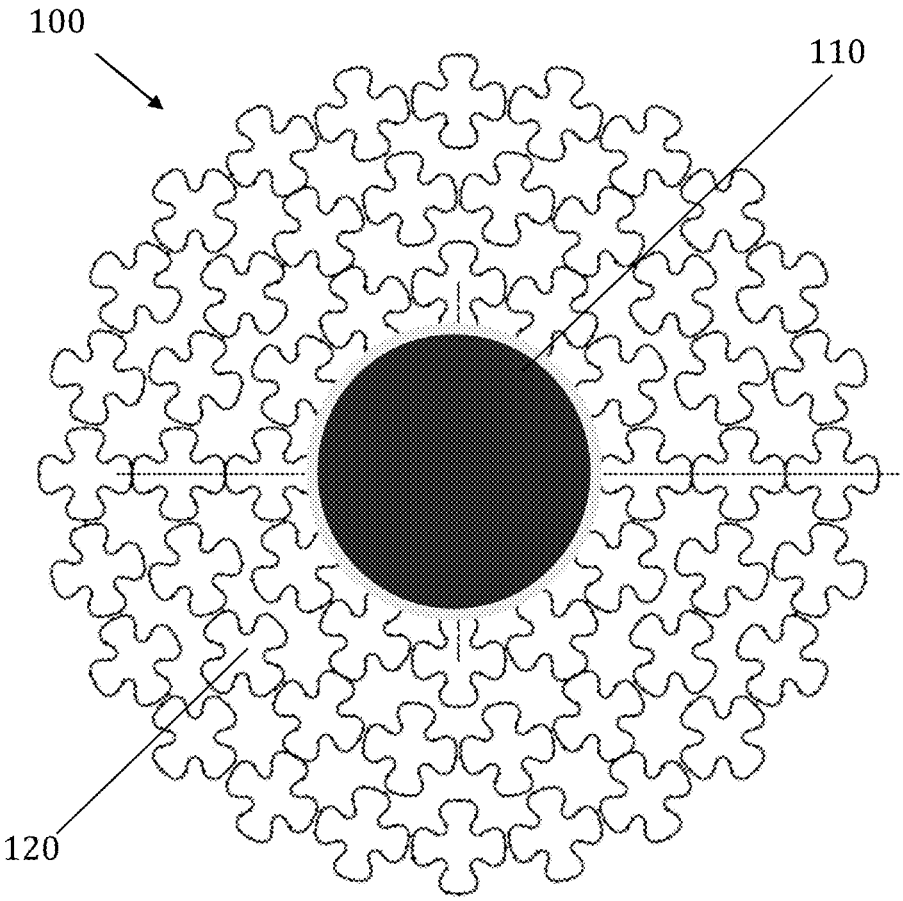
FIG. 1 shows an example of a conductor in accordance with an embodiment of the present invention.

The drawings are merely schematic and non-limiting. In the drawings, the dimensions of some portions may be portrayed in an exaggerated manner and not to scale for illustrative purposes.

Reference numerals in the claims may not be interpreted as limiting the scope of protection. In the various drawings, like reference numerals denote like or similar elements.

DETAILED DESCRIPTION OF ILLUSTRATIVE EMBODIMENTS

The present invention is to be described with reference to particular embodiments and with reference to specific drawings; however, the invention is not limited thereby but rather is merely limited by the claims. The described drawings are merely schematic and non-limiting. In the drawings, the dimensions of some elements may be shown in an exaggerated manner and not to scale for illustrative purposes. The dimensions and the relative dimensions are sometimes not in accordance with the actual implementation of the invention in practice.

Further, the terms first, second, third and the like are used in the description and claims to distinguish between similar elements, and not necessarily to describe an order in time, in space, in priority or in any other regard. It should be understood that the terms used in this manner are interchangeable in appropriate circumstances and that the embodiments of the invention described herein are appropriate for operating in a different order from that described or represented herein.

Moreover, the terms top, bottom, above, in front of and the like are used in the description and claims for descriptive purposes and not necessarily to describe relative positions. It should be understood that the terms used in this manner are interchangeable in certain circumstances and that the embodiments of the invention described herein are also appropriate for operating in different orientations from those described or represented herein.

It should be noted that the term "comprises", as used in the claims, should not be interpreted as limited to the means described thereafter; this term does not exclude any other elements or steps. It should be interpreted to the effect of specifying the presence of the stated features, values, steps or components referred to, but does not exclude the presence or addition of one or more other features, values, steps or components or groups thereof. Thus, the scope of the expression "a device comprising means A and B" should not be limited to devices merely consisting of components A and B. It means that, for the present invention, A and B are the only relevant components of the device.

Reference throughout this specification to "one embodiment" or "an embodiment" means that a specific feature, structure or characteristic described in connection with the embodiment is taken up in at least one embodiment of the present invention. Thus, the presence of the expressions "in one embodiment" or "in an embodiment" in various places throughout this specification need not necessarily refer to the same embodiment in each case, but may indeed do so. Furthermore, the specific features, structures or characteristics may be combined in any appropriate manner, as would be clear to an average person skilled in the art on the basis of this specification, in one or more embodiments.

Similarly, it should be appreciated that, in the description of example embodiments of the invention, various features of the invention are sometimes grouped together in a single embodiment, drawing or description thereof with the aim of streamlining the disclosure and aiding in understanding one or more of the various aspects of the invention. However, this mode of disclosure should not be interpreted as reflecting an intention that the invention should require more features than are explicitly mentioned in each claim. Rather, as is reflected in the following claims, aspects of the invention lie in fewer than all features of a single one of the embodiments disclosed above. Thus, the claims following the detailed description are hereby explicitly incorporated into this detailed description, with each claim in its own right as a particular embodiment of this invention.

Further, whilst some embodiments described herein comprise some, but not others, of the features included in other embodiments, combinations of features of different embodiments are intended to be placed within the scope of the invention, and these form different embodiments, as would be understood by a person skilled in the art. For example, in the following claims, any of the described embodiments can be used in any combination.

In the presently provided description, numerous specific details are set out. However, it should be understood that embodiments of the invention can be implemented without these specific details. In other cases, well-known methods, structures and techniques are not portrayed in detail so as to keep this description clearer.

Where embodiments of the present invention refer to a conductor, this typically refers to a conductor having a central core, this typically being the reinforced element, and an enclosing element, this typically being the conductive material.

Where embodiments of the present invention refer to a cross section of a wire, this refers to a section transverse to the longitudinal direction of such a wire.

Where embodiments of the present invention refer to a circumscribed circle for the cross section of a wire, this refers to the smallest circle that touches the outer edge of the cross section of the wire in such a way that the cross section of the wire is positioned within the edge of, i.e. and thus not outside, this circle.

So as to make the conductors less susceptible to disruptive noise due to direct or indirect alternating electromagnetic fields—the disruptive noise also being referred to as humming—it is typically aimed to make the diameter of the conductor larger than is conventional. However, it is important in this context that the total mass of the conductors does not substantially increase. On the one hand, this has the advantage that there is no extra load on the conductors, since when subject to an excessive mass the conductors may break. On the other hand, this equally has the advantage that the quantity of material which has to be used does not substantially increase, and this has both economic and ecological advantages.

In a first aspect, the present invention relates to a conductor for power transportation. A conductor of this type may for example be used for transmission and distribution of electricity, as high-capacity cables, as supply cables for trains or trams etc. The conductors may for example be used overground, although embodiments are not limited by this.

Figure 3:
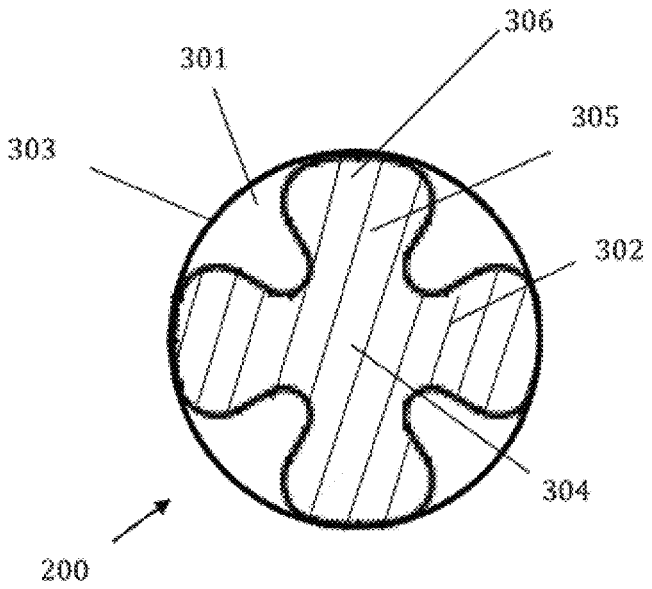
FIG. 3 illustrates a specific example of a cross section of a wire in which the circumscribed circle is shown, as used in the embodiments of the present invention.

The conductor typically comprises an elongated core constructed from a core material and an elongated conductive casing constructed from a conductive material. In accordance with the embodiments of the present invention, the elongated conductive casing is constructed from various layers of wires, each layer of wires consisting of a set of wires positioned next to each other. In this context, at least one of these wires, but preferably several and possibly all of the wires, is shaped in such a way that in the cross section of the wire there is a circumscribed circle only between 50% and 90% full, for example only between 50% and 80% full, of wire material. In other words, the wire is not cylindrical, since the circumscribed circle in a cross section thereof would be 100% filled, but rather the wire is shaped in such a way that part of the circumscribed circle is not full of wire material in the embodiments of the present invention. The shape of these wires is further such that the space taken up by these wires in the stack of wires in the layers is indeed substantially cylindrical. Examples falling under "substantially taking up a cylindrical space" are for example the wires having a section as shown in FIGS. 1, 2 and 3.

The above condition may also be worded differently to the effect that the wires provide a casing in which the layers of the casing have a lower degree of filling than if the layers were constructed by wires having a disc as a cross section. The degree of filling in the casing may for example be less than 90%, for example less than 80%, for example less than 70% or even for example less than 60%.

Further details and standard and optional elements and aspects of the conductor will be discussed further in the following with reference to FIG. 1 and so on. FIG. 1 illustrates a cross section of a conductor 100 in accordance with an embodiment of the present invention. The conductor 100 has an elongated core 110 and an elongated casing 120 which encloses the core.

The elongated core 110 is provided as a reinforced element for the conductor 100. The core material, in other words the material of which the core 110 is constructed, may for example be selected from one of steel, invar, stainless steel, aluminium-coated steel, copper-coated steel, polymer matrix composite material or metal matrix composite material based on carbon fibres or ceramic fibres or other fibres exhibiting high strength. The core 110 may be of a round cross section, or else an alternative cross section may be used such as hexagonal, square etc. The elongated core 110 may be constructed from one wire. In some cases, the core may also consist of a composition of a number of wires. The number of wires is non-limiting in this case, for example 7, 19, 37, 61. These wires may consist both of metal and of composite. The elongated core 110 used as a reinforced element may for example have a diameter of between 4 and 12 mm for cores made of 1 wire, for example between 3 and 12 mm for wrought conductor cores consisting of 7 wires, for example between 5 and 20 mm for wrought conductor cores consisting of 19 wires, for example between 7 and 28 mm for wrought conductor cores consisting of 37 wires, or between 9 and 36 mm for wrought conductor wires made of 61 wires. In some cases, however, the diameter of the core may be even larger.

In accordance with the present invention, the elongated casing 120 comprises a number of layers of wires, the layers typically being constructed concentrically around the core. The circumscribed diameter of the wires or the number of layers of conductive wire is typically greater than in conventional conductors, so as to create a larger diameter for the conductor, resulting in a reduction in the noise caused by the alternating electromagnetic fields and the accompanying humming. Within the layers, the wires may typically be positioned against one another.

The wires may be made of a material selected from one or a combination of copper, copper alloy, aluminium or aluminium alloy.

The conductive material from which the casing is constructed may for example be selected from copper or one of the alloys thereof or aluminium or one of the alloys thereof. The thickness of the casing may vary, but typically a thickness of 20 mm or greater is adhered to, since the aim is specifically to provide a conductor having a large diameter.

In embodiments of the present invention, at least a fraction of the wires, within the same layer and/or within different layers, are shaped in such a way that in the cross section of the wire there is a circumscribed circle only between 50% and 90% full of wire material. In some embodiments, this is preferably only between 50% and 80% or even between 50% and 70%. The wires are thus not complete cylindrical wires (in which the degree of filling with wire material would be 100%). This results in the advantage that the mass of the casing can be 10% to 50% lower for the same diameter or, in other words, that the thickness of the casing can be increased. A greater thickness of the casing, and thus a greater diameter of the conductor, results in a reduction in the mechanical vibrations.

The shape of the conductive wires in the first and/or further layers in the casing is such that, although the conductive wires in the layers of the casing are not complete cylinders, the space taken up by the conductive wires in the stack of the wires in the layers of the casing is indeed substantially cylindrical.

The conductive wires may extend straight along with the core or be wound around the core. The advantage of wound conductive wires is that this results in more stable stacking, in which the wires are pushed into each other less or not at all.

In some embodiments, the conductive wires may also be twisted on themselves around the axial axes thereof. This implies that the cross section of the wire varies along the axial direction of the wire. This likewise has the advantage that adjacent wires are pushed into each other less or not at all.

The cross section of the wires may also be different in the different layers from which the casing is constructed. Within a layer and/or between the layers, wires having different cross sections can thus be used. Thus, for example, alternation of cross sections may be provided in such a way that adjacent wires within a layer never have the same cross section. Alternatively or in addition, alternation of cross sections may be provided in such a way that adjacent wires from different layers never have the same cross section.

FIGS. 2(*a*) to 2(*e*) illustrate a number of examples of cross sections of wires 200 of the casing, in which the degree of filling of the circumscribed circle by the cross section of the wire is between 50% and 90%. These cross sections may be symmetrical or asymmetrical. FIGS. 2 (*a*) and (*b*) shown point-symmetrical designs. FIGS. 2 (*c*), (*d*) and (*e*) show asymmetrical designs. In designs (a), (c) and (e), projecting portions are visible, which deviate to a greater or lesser extent from the circumscribed circle. Although several specific embodiments are shown, this is merely for illustration, and other cross sections may also be used.

In some embodiments, the cross section of the wire exhibits a central portion filled with wire material and a number of projecting portions. These projecting portions may have a lobe shape, a pyramid shape etc. The projecting portions may all have a similar shape or even the same shape or may be variable in shape. In some embodiments, the projecting portions touch the circumscribed circle for the cross section of the wire. The number of projecting portions may be 2, 3, 4, 5, 6, 7, 8 or more. The projecting portions may have a widening further from the core of the wire, in other words tighter against the circumscribed circle. This has the advantage that there is more support for preventing wires positioned next to each other from sliding into one another.

In some embodiments, the wires may be shaped by forming grooves in cylindrical wires.

FIG. 3 illustrates a cross section of a wire 200 in which zones 302 comprising wire material and zones 301 where no wire or wire material is present are represented in the circumscribed circle 303. The specific example likewise shows a central portion 304 filled with wire material, a projecting portion 305 and a widening 306 close to the circumscribed circle.

In a second aspect, the present invention relates to a cable comprising a conductor as described in the first aspect. As well as the conductor, the cable may also comprise further layers of material, such as insulating layers.

In a further aspect, the present invention relates to a wire made of a conductive material, such as copper, a copper alloy, aluminium or an aluminium alloy, the wire having a cross section such that in this cross section a circumscribed circle is only between 50% and 90% full of wire material. The wire is thus not cylindrical with a 100% degree of filling. The cross section of the wire has a central portion filled with wire material and has a plurality of protrusions. The shape of these wires is such that the space taken up by the wire in a stack of these wires is indeed substantially cylindrical, for example, in use for example in layers of a casing of a conductor. The wire may typically be shaped in such a way that, in the cross section, wire material touches the circumscribed circle at least in every quadrant of the circumscribed circle. These can then serve as a support for adjacent wires, or at least prevent the wires from sliding into each other. Further features and advantages of embodiments may correspond to the features and advantages of the wires described for the conductors in the first aspect. The wires may be produced using conventional wire drawing techniques, or for some specific cross-sectional shapes by extrusion.

In another further aspect, the present invention also relates to the use of a wire as described in the preceding aspect for manufacturing a conductor in accordance with the first aspect.

The various aspects may be combined with one another in a simple manner, and the combinations thus likewise correspond to embodiments in accordance with the present invention.

The invention claimed is:

1. A conductor for power transportation, the conductor comprising:

an elongated core constructed from a core material and an elongated conductive casing constructed from a conductive material, wherein the elongated conductive casing is positioned around the elongated core and is constructed from various layers of wires, each layer of wires consisting of a set of wires which are positioned side by side, and wherein at least a fraction of these wires are shaped in such a way that in the cross section of the wire there is a circumscribed circle only between 50% and 90% full of wire material and that the cross section of the wire has a central portion filled with wire material, and the cross section of the wire has a plurality of projections with one or more concavities spaced between each of the one or more projections or the cross section of the wire includes one or more hollow portions defined by an outer portion of the wire, wherein the shape of the one or more projections and the one or more concavities, or the shape of the one or more hollow portions and the outer portion of the wires is such that spaces are provided between the wires that are unoccupied by the wire material in at least a portion of the one or more projections of the one or more hollows, and wherein the shape of these wires is such that the space taken up by the wire in a stack of the wires in the layers is substantially cylindrical.

2. The conductor according to claim 1, wherein the majority of the wires in the layers are shaped in such a way that for the cross section of the wire there is a circumscribed circle only between 50% and 90% full of wire material.

3. The conductor according to claim 1, wherein the plurality of projections touches the circumscribed circle.

4. The conductor according to claim 1, wherein the plurality of projections is of a similar shape or wherein the plurality of projections is of a lobe shape, or wherein the plurality of projections is uniformly distributed over the periphery of the cross section or wherein the plurality of projections is configured in such a way that they exhibit a widening close to the circumscribed circle.

5. The conductor according to claim 1, wherein the cross section is point-symmetrical.

6. The conductor according to claim 1, wherein the cross section is asymmetrical.

7. The conductor according to claim 1, wherein, in the cross section, wire material touches the circumscribed circle at least in every quadrant of the circumscribed circle.

8. The conductor according to claim 1, wherein in the cross section of the wire a circumscribed circle is only between 50% and 80% full of wire material.

9. The conductor according to claim 1, wherein the wire is a cylindrical wire provided with a plurality of grooves in the outer edge of the cylindrical wire.

10. The conductor according to claim 1, wherein at least one of these wires is twisted.

11. The conductor according to claim 1, wherein at least one of these wires is wound around the central core and/or wherein different wires have a different cross section.

12. The conductor according to claim 1, in which the wires of the conductive casing consist of a material selected from one of copper, copper alloy, aluminium or aluminium alloy.

13. The conductor according to claim 1, in which the core is made of a core material selected from one of invar, metal matrix composite, polymer matrix composite, steel, aluminium-coated steel, copper-coated steel or stainless steel.

14. A cable comprising a conductor according to claim 1.

15. A conductive wire, wherein the wire is shaped in such a way that in the cross section of the wire there is a circumscribed circle only between 50% and 90% full of wire material, wherein a cross section of the wire has a central portion filled with wire material and the cross section of the wire has a plurality of projections with one or more concavities spaced between each of the one or more projections or the cross section of the wire includes one or more hollow portions defined by an outer portion of the wire, wherein the shape of the one or more projections and the one or more concavities, or the shape of the one or more hollow portions and the outer portion of the wire is such that spaces are provided between the wire and a same wire that are unoccupied by the wire material in at least a portion of the one or more projections of the one or more hollows, and wherein the shape of the wire is such that the space taken up by the wire in a stack of same wires is substantially cylindrical.

16. The conductive wire according to claim 15, wherein the plurality of projections touches the circumscribed circle.

17. The conductive wire according to claim 15, wherein the plurality of projections has a similar shape, or wherein the plurality of projections has a lobe shape, or wherein the plurality of projections is uniformly distributed over the periphery of the cross section, or wherein the plurality of projections is configured in such a way that they exhibit a widening close to the circumscribed circle.

18. The conductive wire according to claim 15, wherein the cross section is point-symmetrical or wherein the cross section is asymmetrical.

19. The conductive wire according to claim 15, wherein, in the cross section, wire material touches the circumscribed circle at least in every quadrant of the circumscribed circle.

20. The conductive wire according to claim 15, wherein the wire is twisted.

* * * * *